US007303342B2

(12) United States Patent
Yamamoto et al.

(10) Patent No.: US 7,303,342 B2
(45) Date of Patent: Dec. 4, 2007

(54) PRINT CONTROL APPARATUS AND PRINT CONTROL PROGRAM

(75) Inventors: Yoshijiro Yamamoto, Toyokawa (JP); Hideo Ueno, Nagoya (JP); Mizue Terai, Kasugai (JP); Naruhito Muto, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 377 days.

(21) Appl. No.: 10/795,381

(22) Filed: Mar. 9, 2004

(65) Prior Publication Data

US 2004/0189733 A1 Sep. 30, 2004

(30) Foreign Application Priority Data

Mar. 31, 2003 (JP) ..... 2003-093450

(51) Int. Cl.
*B41J 5/30* (2006.01)

(52) U.S. Cl. ..... 400/62; 400/61

(58) Field of Classification Search ..... 400/61, 400/68, 62, 76, 615.2, 611, 621
See application file for complete search history.

(56) References Cited

U.S. PATENT DOCUMENTS 5,374,130 A 12/1994 Hirono
5,401,110 A * 3/1995 Neeley ..... 400/621
5,503,482 A * 4/1996 Kawakami et al. ..... 400/83
5,562,353 A * 10/1996 Handa et al. ..... 400/615.2
5,799,982 A * 9/1998 McClure et al. ..... 283/81
5,933,589 A 8/1999 Hidaka et al.
6,182,565 B1 * 2/2001 Takayama et al. ..... 101/35
6,371,670 B1 4/2002 Kojo
6,452,694 B1 9/2002 Eisenberg et al.
6,644,873 B2 * 11/2003 Kurashina ..... 400/61
2001/0028308 A1 * 10/2001 De La Huerga ..... 340/573.1
2004/0004113 A1 * 1/2004 Blankenship ..... 235/375

FOREIGN PATENT DOCUMENTS

EP A 0 624 855 11/1994
EP A 1 369 252 12/2003
JP A 6-320826 11/1994

* cited by examiner

*Primary Examiner*—Anthony H. Nguyen
(74) *Attorney, Agent, or Firm*—Oliff & Berridge, PLC

(57) ABSTRACT

A cable label having a desired configuration is provided without forcing a user to do any troublesome work. A character string to be printed on a cable label is memorized in a character string memory section. A print image generating section generates a character string memorized in the character string memory section. A designation and its outside diameter value, for example, of each of plural cables are memorized in a cable information memory section. A label length determining section determines the length of a cable label based on the outside diameter value of a selected cable. A print image arranging section arranges a print image generated by the print image generating section within a length determined by a label length determining section.

35 Claims, 14 Drawing Sheets

PRINT CONTROL APPARATUS AND PRINT CONTROL PROGRAM

BACKGROUND OF THE INVENTION

1. Field of Invention

The present invention relates to a print control apparatus and a print control program used for printing a character string on labels for cylindrical objects such as, for example, a cable label to be wound around a cable-like member.

2. Description of Related Art

It is known to provide a tape printer capable of printing a character string on a print tape in which an adhesive print object sheet whose rear face is coated with adhesive agent and a separation paper are laid together such that they can be separated.

Japanese Patent Application Laid-Open No. 6-320826, pp. 5-10, FIG. 14, discloses that a worker can recognize a cable by seeing a character string printed on the cable label so as to prevent wiring error from occurring by winding a tape printed by this tape printer around a cable so that both end sections thereof are to be bonded together as a cable label.

If it is intended to obtain a cable label having a length corresponding to the outside diameter of a cable, a user of the tape printer needs to obtain the outside peripheral length of the cable based on the outside diameter of the cable, and input that calculation result into the printer. However, calculating the outer peripheral length of the cable is troublesome for the user, and if the user makes a mistake in the calculation, a cable label having a configuration not suitable for usage is produced. For example, a region to be wound around the cable may be shorter or longer than the desired length, and consequently, this cable label is wasted.

SUMMARY OF THE INVENTION

One object of the present invention is to provide a print control apparatus and a print control program capable of producing a cable label having a desired configuration without requesting a user to do troublesome processing or calculations.

To achieve the above and/or other objects, according to an aspect of the present invention, there is provided a print control apparatus having: character string memory means for storing a character string to be printed on a label for a cylindrical object such as, for example, a cable label to be wound around a cable-like member; print image generating means for generating a print image of the character string stored in the character string memory means; information memory means for storing identification information and dimension information about part of, or an entire configuration of, the cable label to be wound around each cable-like member regarding plural cable-like members; and print image arranging means for, when a cable-like member corresponding to any one of identification information pieces of plural cable-like members memorized in the information memory means is selected by a user, arranging a print image generated by the print image generating means at least within any one of a range corresponding to the part of, or the entire configuration of, a cable label for the selected cable-like member memorized in the information memory means and a range adjacent to this range.

With this structure, by a user's selecting a cable-like member around which a cable label is to be wound, the cable label in which a character string is printed at least within any one of a range corresponding to part of, or the entire cable label of, and a range adjacent to this range for the selected cable-like member can be obtained. Thus, a necessity of the user's calculating the configuration of the cable label is eliminated, thereby reducing the work load of a user. Further, because a possibility of calculation error by a user is eliminated, a cable label in which part of, or the entire configuration thereof, is a desired one can be obtained.

According to another aspect of the present invention, there is provided a print control apparatus having: character string memory means for storing a character string to be printed on a label for a cylindrical member, such as, for example, a cable label to be wound around a cable-like member; print image generating means for generating a print image of the character string stored in the character string memory means; information memory means for memorizing identification information and dimension information of each cable-like member in correspondence therebetween regarding plural cable-like members; label configuration determining means for, when a cable-like member corresponding to any one of the identification information of plural cable-like members memorized in the information memory means is selected by a user, determining the part of, or the entire configuration of, the cable label based on the dimension of the selected cable-like member memorized in the information memory means; and print image arranging means for arranging a print image generated by the print image generating means at least within any one of a range corresponding to the part of, or the entire configuration of, a cable label determined by the label configuration determining means and a range adjacent to this range.

With this structure, if a user selects a cable-like member around which a cable label is to be wound, part of, or the entire configuration of, the cable label is determined based on the dimension of the cable-like member, so that a cable label in which a character string is printed within any one of a range corresponding to the determined configuration and a range adjacent to this range can be obtained. Thus, the necessity of the user's calculating for the part of, or the entire configuration of, the cable label is eliminated, thereby reducing the work load on the user. Further, mistakes in calculation by the user are eliminated, so that a cable label in which the part of, or the entire configuration thereof, is a desired one can be obtained.

Preferably, the print control apparatus of aspects of the present invention further includes adjacent range configuration determining means for determining the configuration of a range adjacent to the range corresponding to the part of, or the entire configuration of, the cable label. Consequently, the configuration of the adjacent range can be made appropriate. Thus, because the length of the overlapping region can be made appropriate, it is possible to prevent a printed character string from being hidden by the cable label itself.

In this case, the adjacent range configuration determining means may change the configuration of the adjacent range corresponding to the dimension of a cable-like member. Consequently, by changing the overlapping region based on the dimension of the cable-like member, the overlapping region length can be adjusted corresponding to the cable-like member, so that the section to be attached to the overlapping region becomes difficult to be separated.

According to aspects of the present invention, the dimension of the cable-like member may be an outside diameter value of the cable-like member. Consequently, a predetermined value of the cable-like member can be used as it is and therefore, the necessity of calculation of the dimension is eliminated.

According to aspects of the present invention, preferably, the memory content of the information memory means is rewritable based on a user's operation. Consequently, any cable-like member can be registered additionally based on a user's desire, so that this apparatus is convenient for the user.

Preferably, the print control apparatus of aspects of the present invention further includes identification information display control means for controlling representation of identification information of a cable-like member memorized in the information memory means on a display. Consequently, the identification information of the cable-like member is represented on the display, so that a user can select a cable-like member more easily.

In this case, preferably, the identification information display control means changes the display order of identification information of the cable-like member on the display corresponding to the selection frequency or selection order of the cable-like member by a user. Consequently, the user can select a cable-like member more easily.

Preferably, the print control apparatus of aspects of the present invention further includes fine adjustment means for adjusting the part of or the entire cable label finely. Consequently, a gap between the part of, or the entire configuration of, a cable label obtained theoretically by calculation of dimensions of the cable-like member and the part of, or the entire configuration of, an actually necessary cable label can be filled, so that excess or shortage of the cable label hardly occurs when the cable label is wound around the cable-like member.

In this case, the fine adjustment means may be capable of adjusting the part of or the entire cable label finely independently for individual cable-like members. Consequently, deviations in dimension of the cable-like member can be considered for individual cable-like members. Alternatively, the fine adjustment means may be capable of adjusting the part of or the entire cable label finely in a batch as for plural cable-like members. Consequently, a gap between the part of, or the entire configuration of, a cable label theoretically obtained by calculation of dimensions of the cable-like member and the part of, or the entire configuration of, a cable label actually necessary can be considered in batches.

According to aspects of the present invention, the print image arranging means may arrange a print image generated by the print image generating means within a print range included in at least any one of a range corresponding to the part of, or the entire cable label, and a range adjacent to this range, in the width direction of the cable label. Consequently, the print image is arranged in the width direction of the cable label, thereby improving the visibility of the character string.

According to aspects of the present invention, the print image arranging means may arrange a print image generated by the print image generating means substantially in the center of a print range included in at least any one of a range corresponding to the part of, or the entire cable label, and a range adjacent to this range, in the width direction of the cable label. Consequently, the print image is disposed substantially in the center of the print range, so that the printed section of the print image of the cable label is wound around the cable-like member securely. Therefore, the visibility of the character string is improved.

According to aspects of the present invention, the print image arranging means may arrange plural print images generated by the print image generating means within a print range included in at least any one of a range corresponding to the part of, or the entire cable label, and a range adjacent to this range, at an equal interval in the width direction of the cable label. Consequently, plural character strings are disposed equally within the print range, so that an observer can recognize the character string from any direction.

According to aspects of the present invention, the print image arranging means may arrange plural print images generated by the print image generating means within a print range included in at least any one of a range corresponding to the part of, or the entire cable label, and a range adjacent to this range, in the width direction of the cable label, while at least a print image different in arrangement direction from the others may be included in the plural print images. Consequently, print images in an upside down direction are included in plural print images, so that there is no fear that the character string may be seen in the upside down condition by a user after it is wrapped around the cable-like member, thereby the visibility of the character string being improved. Further, the observer can view at least one character string not in an upside down direction by rotating the cable-like member in the axial direction. From this point also, the visibility of the character string is improved.

According to aspects of the present invention, the print image arranging means may arrange plural print images generated by the print image generating means within a print range included in at least any one of a range corresponding to the part of, or the entire cable label, and a range adjacent to this range, in the width direction of the cable label while the arrangement directions of the plural print images may be different by 180° alternately. Consequently, a print image in the upside down direction is included in plural character strings alternately so that the fear that the character string may be viewed in the upside down condition depending on an observer is substantially eliminated, thereby the visibility of the character string is improved.

According to aspects of the present invention, the print image arranging means may arrange plural print images generated by the print image generating means within a print range included in at least any one of a range corresponding to the part of, or the entire cable label, and a range adjacent to this range, in the width direction of the cable label, while of the plural print images, two print images disposed most outside may be different by 180° in arrangement direction. Consequently, if the regions near both ends of the cable label wound around the cable-like member are bonded together through their rear faces, two character strings upside down to the observer are represented on the front and rear faces. Thus, the character string on one side is right-side-up in its vertical direction so that it can be recognized easily.

Further, a print control apparatus of aspects of the present invention may further include character size determining means for determining the size of a print image to be disposed at least within any one of a range corresponding to the part of, or the entire cable label, and a range adjacent to this range corresponding to the dimension of a cable-like member selected by a user. Consequently, a character string having an appropriate size for the dimension of the cable-like member can be printed.

According to aspects of the present invention, the information memory means may include a nonvolatile memory device. Consequently, the identification information of the cable-like member and the dimension of the cable-like member are stored even if the power is turned OFF, so that these data do not need to be input again each time when the power is turned ON.

According to still another aspect of the present invention, there is provided a program for making a computer (including electronic devices capable of executing a program containing processing devices such as a CPU) function as the above-described print control apparatus. Such a program can be stored on and/or distributed through a removable type recording medium such as a CD-ROM, FD, MO and a fixed type recording medium such as a hard drive or through a communication network such as Internet by wired or wireless electric communication means.

BRIEF DESCRIPTION OF THE DRAWINGS

Exemplary embodiments of the invention will be described below in detail with reference to the accompanying drawings in which.

DETAILED DESCRIPTION OF EXEMPLARY EMBODIMENTS

Hereinafter, preferred exemplary embodiments of the present invention will be described in detail with reference to the accompanying drawings.

Figure 1:
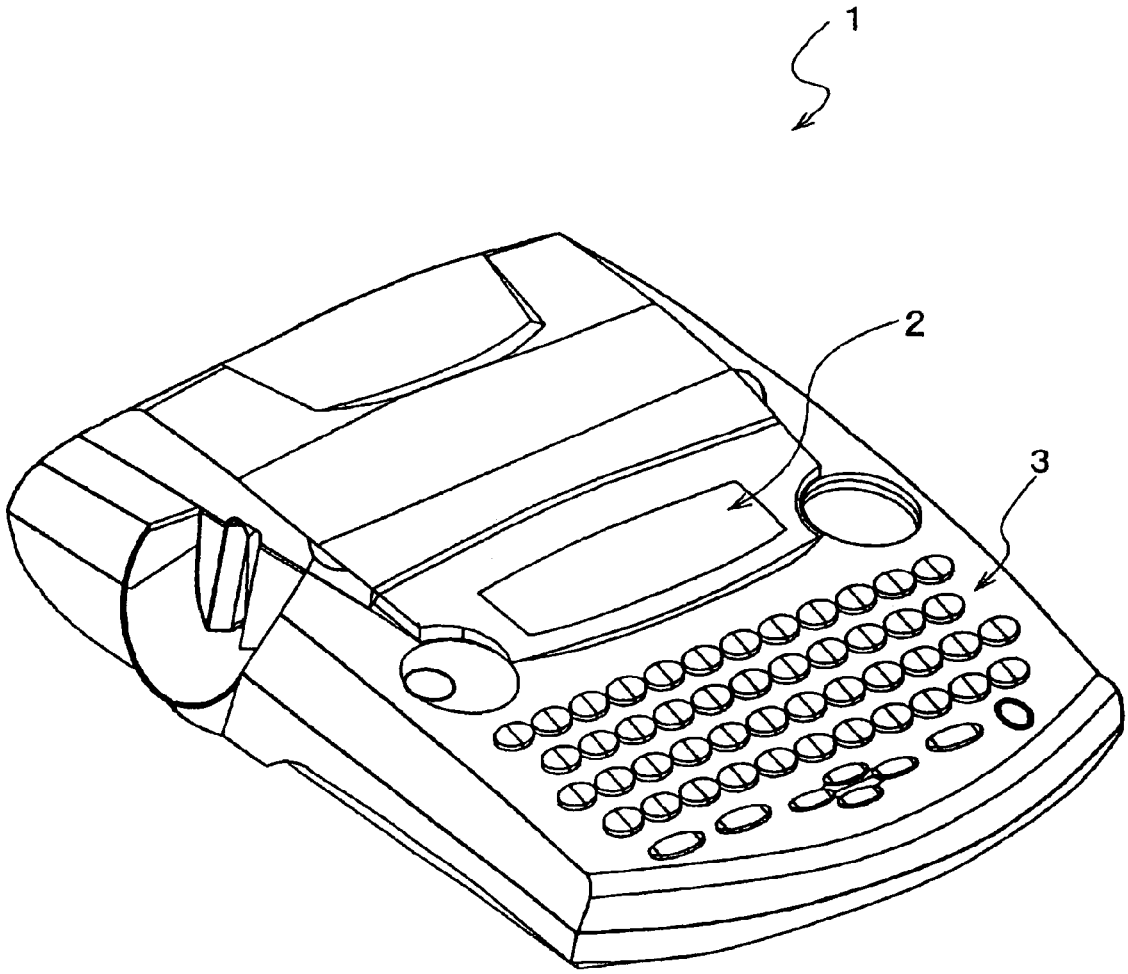
FIG. 1 is a perspective view of a tape printer accommodating a print control apparatus according to a first embodiment of the present invention.

FIG. 1 is an appearance view of a tape printer corresponding to a first embodiment of the present invention. As shown in FIG. 1, a display 2 and a keyboard 3 are disposed on a front face of a tape printer 1. A cover which can be opened/closed is provided on a rear section of the tape printer 1 and a cassette loading section (not shown) having a thermal head 4 (see FIG. 6) is disposed inside thereof.

A print tape which is a print object medium of the tape printer 1 has a print object surface on which characters and symbols are to be printed and is produced by overlaying a print object sheet which is a long tape-like print medium having an adhesive material layer on the back face and a separation sheet having a separable surface treated with silicone resin or the like such that they can be separated. The print tape 10 is accommodated in a label cassette in a condition that it is wound in the form of a roll, and then this label cassette is loaded on the tape printer 1 detachably through a cassette loading section. The print tape 10 is pulled out from the label cassette inside the tape printer 1 and printed by the label exposing section. After that, it is cut out to an appropriate length and the print object sheet is released from the separation sheet, so that this label can be attached to a desired product as a label.

Next, the label obtained by the tape printer 1 will be described. The tape printer 1 is capable of performing ordinary print in which a character string is printed along the length direction of the print tape 10, and also is capable of performing rotary print in which the character string is printed along the width direction of the print tape 10. Here, a cable label which undergoes the rotary print will be described. The cable label which undergoes the rotary print is classified into type A in which an overlapping region is formed only in the vicinity of an end section in the length direction, and type B in which a character string is printed in the vicinity of both end sections in the length direction while no character string is printed in the central section.

Figure 2A:
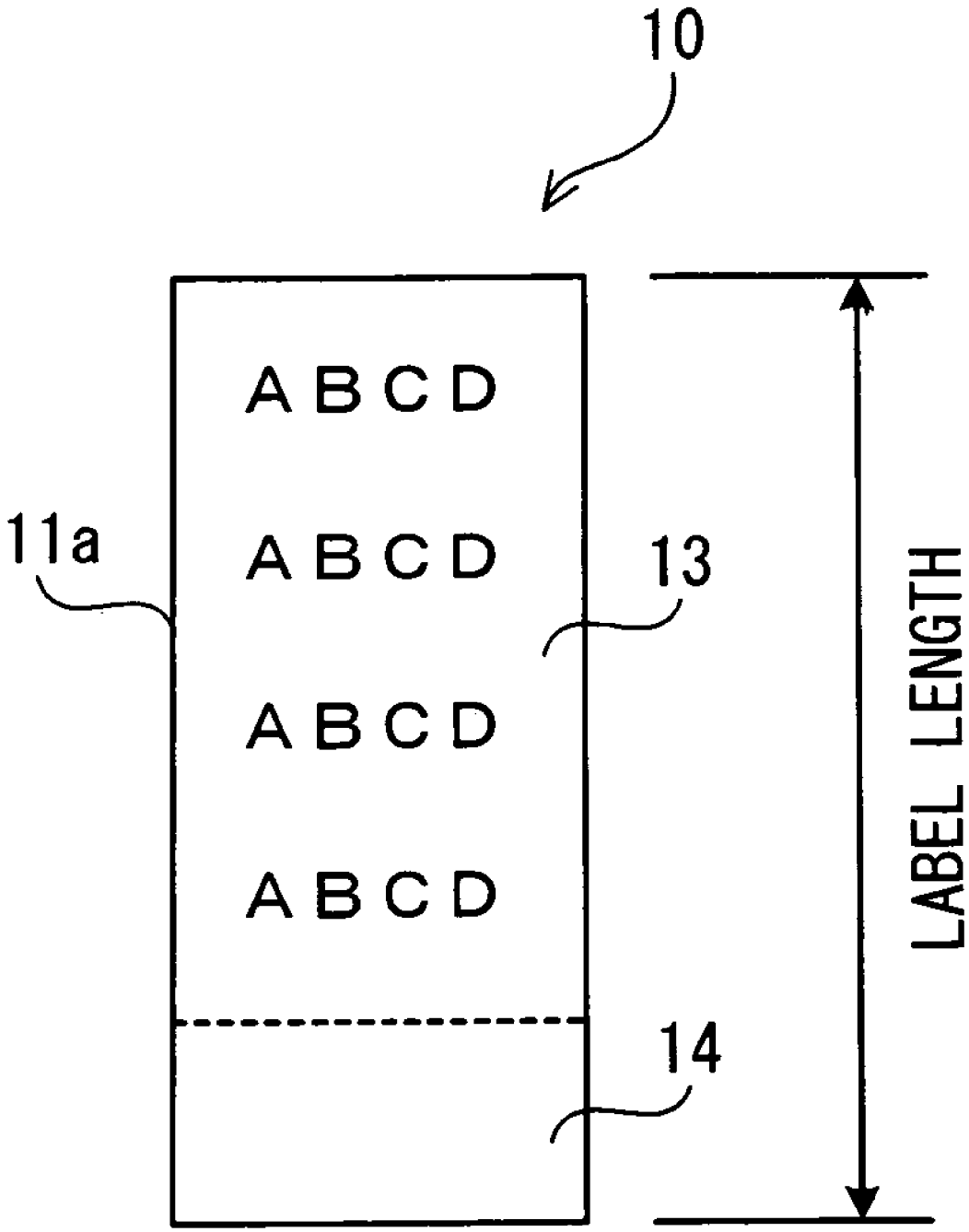
FIG. 2A is an example of print of a cable label obtained by the tape printer shown in FIG. 1.
Figure 2B:
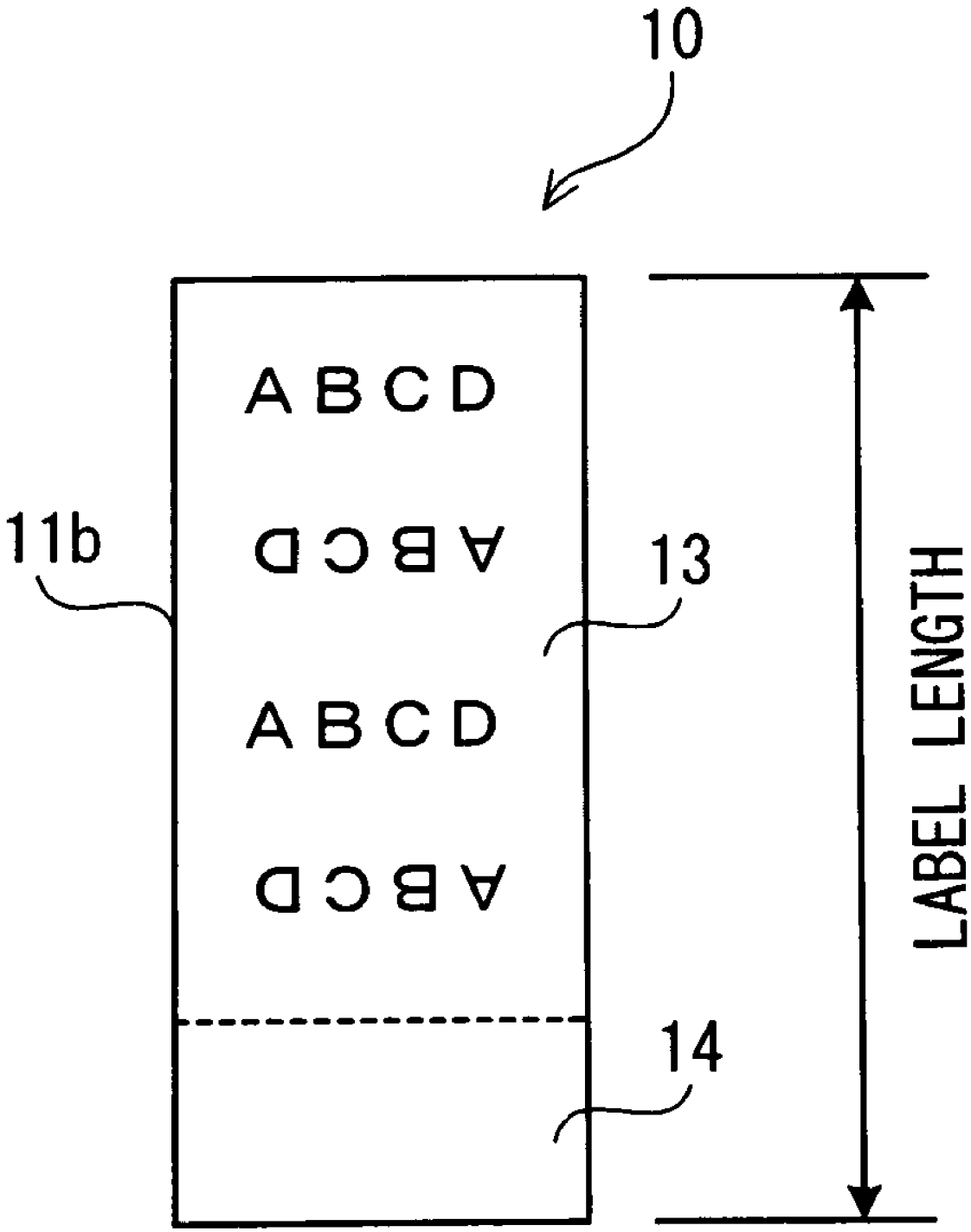
FIG. 2B is another example of print of a cable label obtained by the tape printer shown in FIG. 1.

FIGS. 2A-B show appearance views of the printed cable label of the type A obtained by the tape printer 1. Cable labels 11*a*, 11*b* shown in FIGS. 2A-B are comprised of a label region 13 and an overlapping region 14 adjacent in the length direction. The label region 13 is to be wound around a cable to facilitate identification of a cable object to its attachment, and desired four character strings (ABCD here) are printed thereon. The length of the label region 13 is substantially equal to the outside peripheral length (i.e., the circumference) of the cable for use. The overlapping region 14 is a region to be overlapped under the vicinity of the other end of each of the cable labels 11*a*, 11*b*. A sum of the length of the label region 13 and the length (overlapping length) of the overlapping region 14 is total length of the cable labels 11*a*, 11*b*.

In some case, the character string is printed in the label region 13 such that all the characters are in the same direction along the width direction of the label 11*a*, as shown in FIG. 2A and in some case, as shown in FIG. 2B, the character strings are printed such that they are in opposite directions alternately (the arrangement direction of the character string differs by 180° alternately). The multiple character strings are printed at an equal interval along the length direction of the label region 13 both in the former and latter cases. A dotted line indicated in FIGS. 2A-B indicates a border between the respective regions, and it is not an actually printed line.

Figure 3:
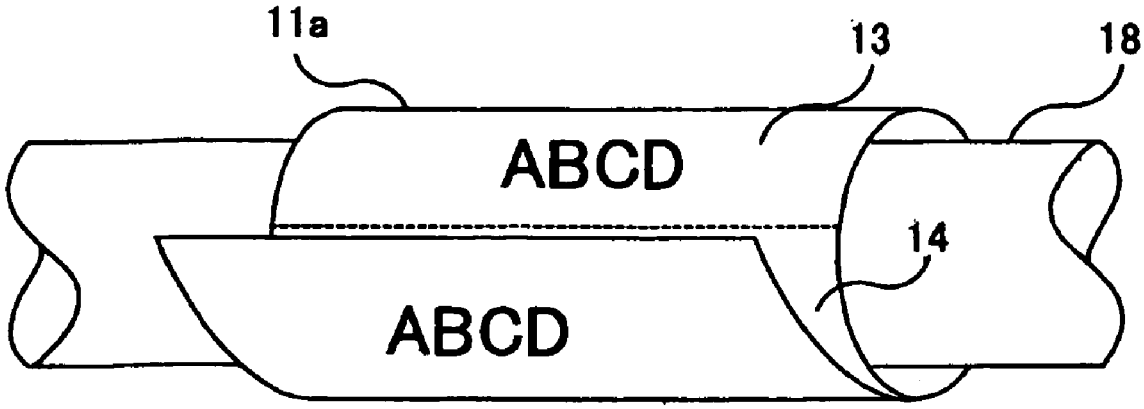
FIG. 3 is an appearance view of the label shown in FIG. 2 attached to a cable.

FIG. 3 is an appearance view indicating the state in which the cable label 11*a* is attached to a cable 18. When the cable label 11*a* is attached to the cable 18, first, the overlapping region 14 is wound around the outer periphery of the cable 18. At this time, attention is paid so that the width direction of the cable label 11*a* is coincident with the axial direction of the cable 18. Further, subsequent to the overlapping region 14, the label region 13 is wound around the cable 18. Finally, the overlapping region 14 is covered with a section near an end of the label region 13 and a section near the other end of the label region 13 is overlaid on the overlapping region 14.

Because the character string is disposed in the width direction of the cable labels 11*a*, 11*b*, particularly when the outside diameter of the cable 18 is smaller than the size of the character, visibility of the character string is better. Further, because the character string is disposed in an entire range including a substantially central point of the label region 13, the section in which the character string is printed is wound around the cable 18 securely. Therefore, the visibility of the character string is improved. Further, because the four character strings are disposed equally within the label region 13, an observer can recognize those character strings in any direction. Further, in case of the cable label 11*a*, even if the cable 18 is rotated in the axial direction, a user always can recognize a character string disposed in the same direction.

If the cable label 11*b* shown in FIG. 2B is attached to the cable 18, upside down character strings are included in the four character strings, and thus there is little fear that the observer cannot help reading the upside down character string, thereby improving the visibility of the character string. Further, if the observer rotates the cable 18 in the axial direction, he can find out at least one character string which is not upside down. For this reason also, the visibility of the character string is improved. Particularly because the four character strings differ by 180° alternately in arrangement direction in the cable label 11*b* shown in FIG. 2B, it comes that character strings in opposite directions are included in the four character strings alternately, thereby substantially eliminating fear that all the character strings are seen in upside down condition and consequently, the visibility of the character string is further improved.

Figure 4A:
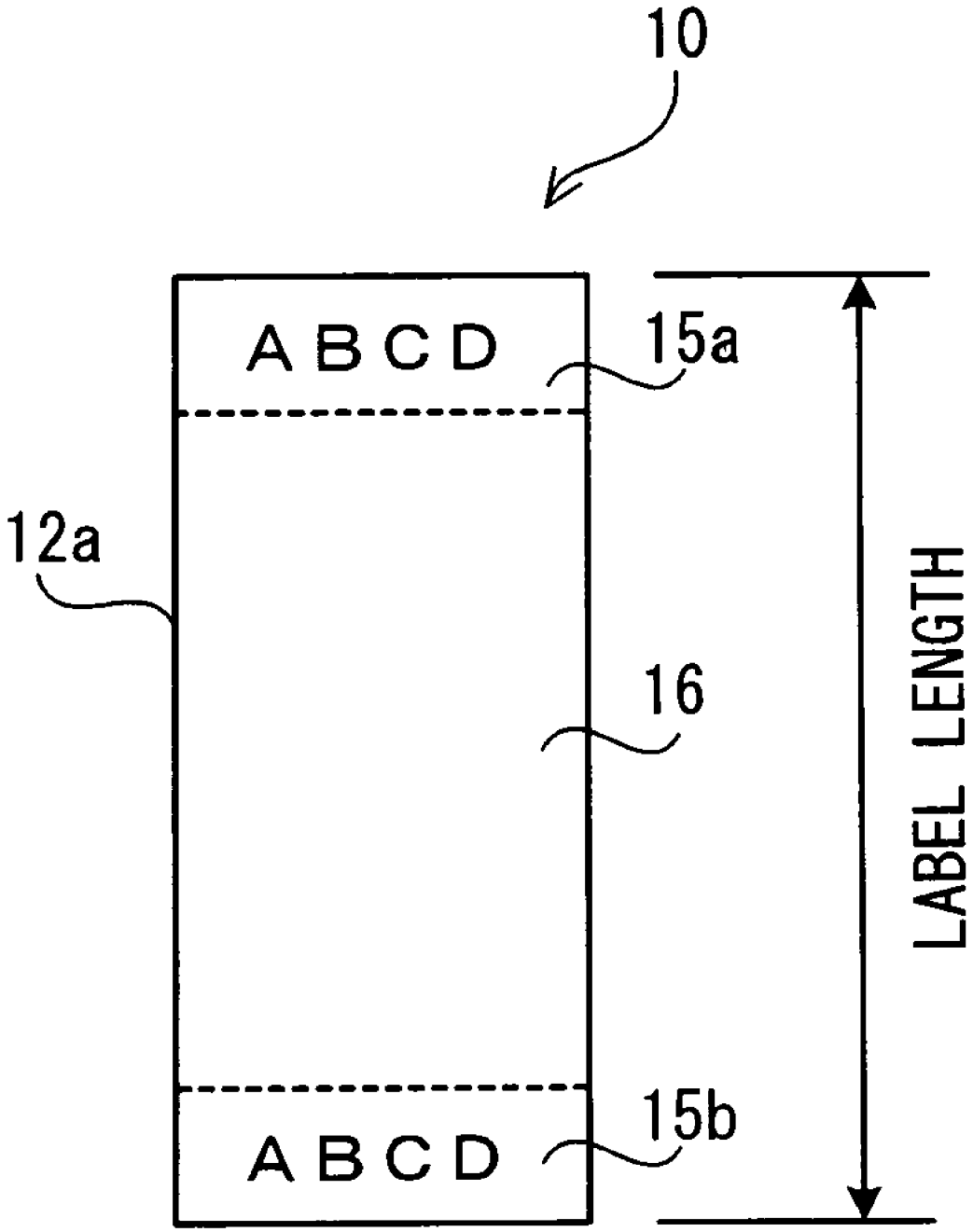
FIG. 4A is an example of print of the cable label obtained by the tape printer shown in FIG. 1.
Figure 4B:
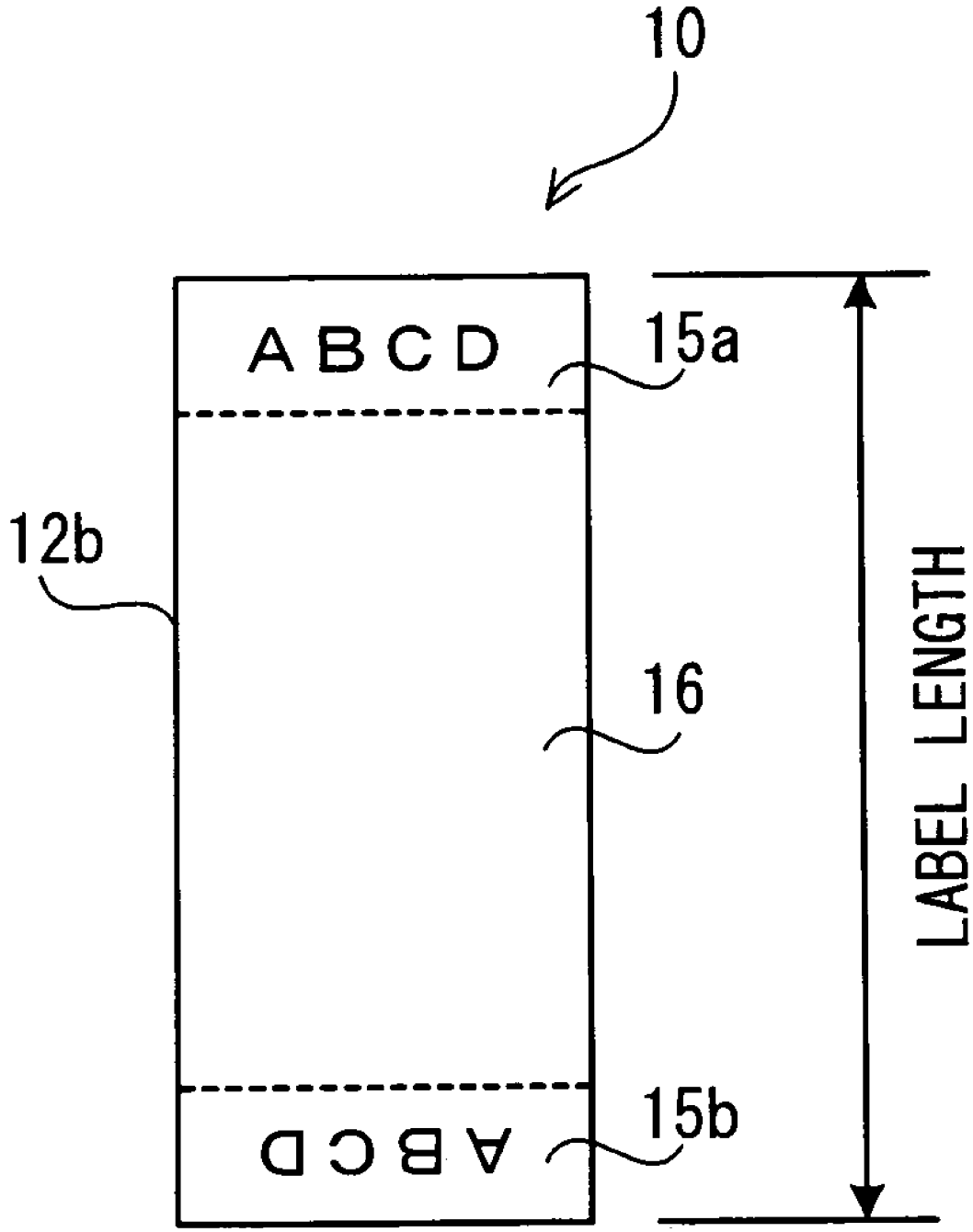
FIG. 4B is another example of print of the cable label obtained by the tape printer shown in FIG. 1.

FIGS. 4A-B are appearance views of a printed cable label of the type B obtained by the tape printer 1. The cable labels 12*a*, 12*b* shown in FIGS. 4A, B are comprised of a label region 15*a*, 15*b* provided on both ends and a cable region 16 disposed between the label regions 15*a* and 15*b*. A desired single character string ("ABCD" here) is printed in each of the label regions 15*a*, 15*b*. The length of the cable region 16 is substantially the same as the cable outside peripheral length (circumference). The total sum of the length of the label regions 15*a*, 15*b* and the length of the cable region 16 is a total length of the cable labels 12*a*, 12*b*.

In the cable label 12*a*, as shown in FIG. 4A, a character string printed in the label region 15*a* and a character string printed in the label 15*b* are in the same direction as the width direction of the label 12*a*. On the other hand, in the cable label 12*b*, as shown in FIG. 4B, a character string printed in the label region 15*a* and a character string printed in the label region 15*b* are in opposite direction (the arrangement direction of the character string differs by 180° alternately) although they are in the same direction as the width direction of the label 12*a*. In the meantime, the dotted line shown in FIGS. 4A-B facilitates identification of a border between the respective regions and is not a line actually printed.

Figure 5:
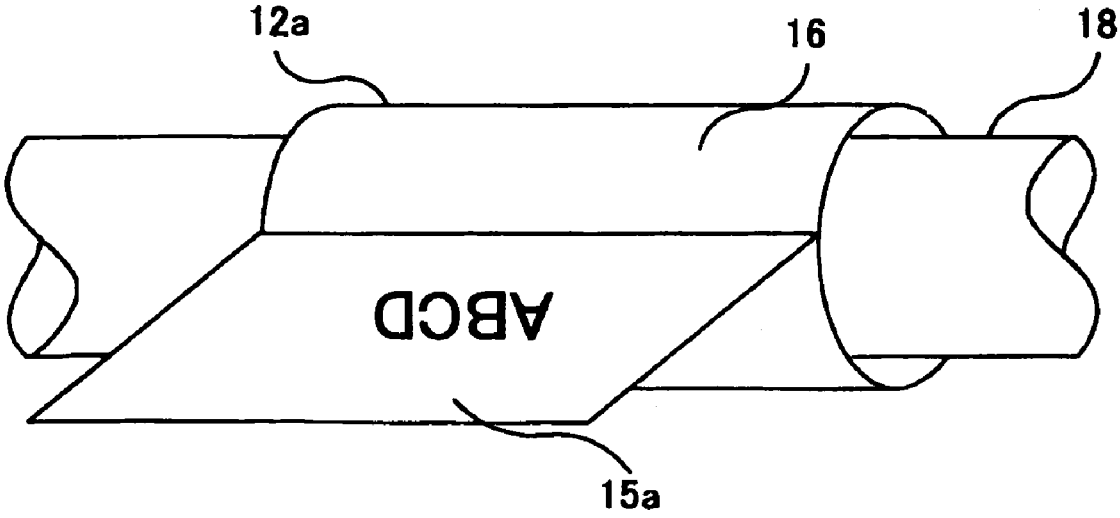
FIG. 5 is an appearance view of the label shown in FIG. 4 attached to the cable.

FIG. 5 is an appearance view showing the state in which the cable label 12*a* is attached to the cable 18. To attach the cable label 12*a* to the cable 18, first the cable region 16 is wound around the outer periphery of the cable 18. At this time, the width direction of the cable label 12*a* is made coincident with the axial direction of the cable 18. Further, both the label regions 15*a*, 15*b* are overlapped with each other such that they are located in a direction substantially perpendicular to the surface of the cable 18 while their backs oppose each other.

In the cable label 12*a*, a user can always recognize character strings in the same arrangement direction even if the cable 18 is rotated in the axial direction.

If sections near both ends of the cable label 12*b* shown in FIG. 4B are bonded together through their rear faces as shown in FIG. 5, the arrangement directions of the character strings printed in the label regions 15*a*, 15*b* differ by 180°. As a result, two character strings which are upside down are indicated on the front and rear faces.

Figure 6:
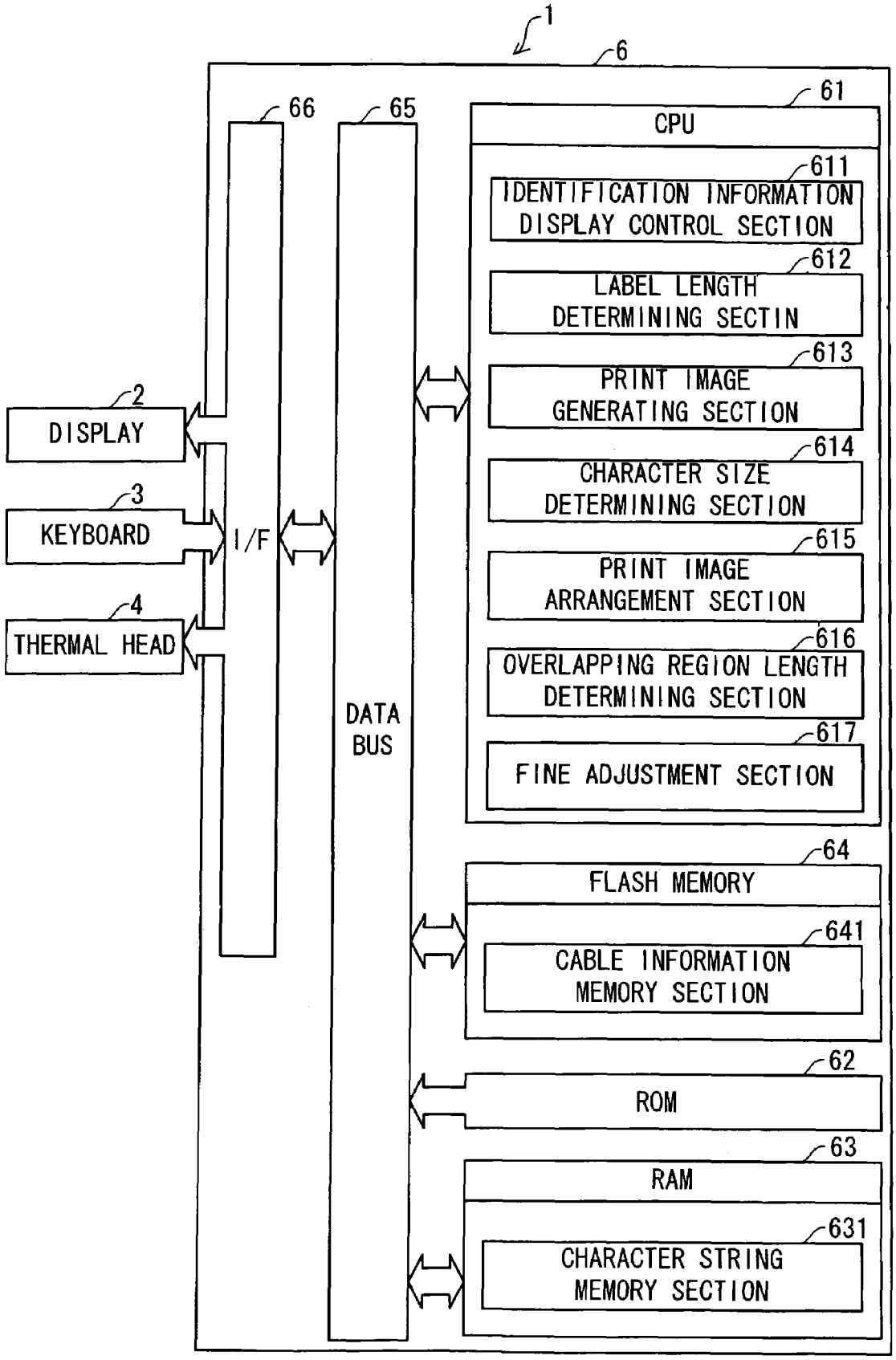
FIG. 6 is a block diagram showing an internal structure of the tape printer shown in FIG. 1.

Next, the structure of the tape printer 1 will be described with reference to FIG. 6. FIG. 6 is a block diagram showing the structure of the tape printer 1. The tape printer 1 comprises the display 2, the keyboard 3, a thermal head 4 and a control section 6. The display 2 is composed of a monochrome liquid crystal display in this exemplary embodiment.

The keyboard 3 is disposed on the surface of the tape printer 1 and includes a text key for inputting characters to be printed, a cursor key for moving the cursor and a function allocation key (print key, cable information setting key and the like) for specifying various functions of the tape printer 1.

The thermal head 4 is provided within a cassette loading unit and disposed at a position corresponding to the tape exposing section provided on a side face of the tape cassette. A plurality of electric heating elements controlled electrically by the control section 6 are disposed on the thermal head 4 along the width direction of the print tape 10 (perpendicular to the length direction of the print tape).

The control section 6 comprises a central processing unit (CPU) 61, a read only memory (ROM) 62, a random access memory (RAM) 63, a flash memory 64, a data bus 65 and an interface unit 66. The CPU 61 is a central processing unit for executing operational processing following various kinds of commands. The ROM 62 is a nonvolatile memory dedicated for reading, and stores an operation program for controlling each function in FIG. 6 to actuate the flow chart of FIGS. 8-12 by the CPU 61. The RAM 63 is a volatile reading or writing memory for storing data temporarily when the. CPU 61 executes a program. The flash memory 64 is a nonvolatile memory which allows a user to write and erase data and is comprised of a cable information storage section 641 and an area for storing other data necessary for executing a program.

The interface unit 66 is a connecting section for electrically connecting such a component as the display 2 separated as a module directly or indirectly with the control section 6. The data bus 65 is a data transfer line group for electrically connecting the CPU 61, the ROM 62, the RAM 63, the flash memory 64 and the interface unit 66. All transmission data in the control section 6 is transmitted through the data bus 65.

Next, the function of the tape printer 1 will be described with reference to FIG. 6. The control section 6 includes a character string memory section (character string memory means) 631 provided as the RAM 63, a cable information memory section (information memory means) 641 provided as the flash memory 64, and the CPU 61, which functions as: an identification information display control section (identification information display control means) 611, a label length determining section (label configuration determining means) 612, a print image generating section (print image generating means) 613, a character size determining section (character size determining means) 614, a print image arranging section (print image arranging means) 615, an overlap region length determining section (adjacent configuration determining means) 616 and a fine adjustment section (fine adjustment means) 617.

The character string memory section 631 stores character data of a character string of a print object input through the keyboard 3 by a user. The character data includes text code corresponding to font data memorized in the ROM 62 and data for determining the content of modification, character size and the like.

The cable information memory section 641 stores plural pieces of cable information. The cable information includes a cable designation and its outside diameter value (or its circumference, for example). Because the cable,information can be added, deleted or edited based on keyboard operation by a user as it is memorized in the flash memory 64, the tape printer can be used conveniently by the user. Further, because the cable information is stored without being deleted even if power is turned OFF, the cable information does not have to be input again each time when the power is turned ON.

The identification information display control section 611 controls processing for displaying a list of plural pieces of the cable information stored in the cable information memory section 641, and the user selecting character string which indicates a processing to be executed on a next stage with characters on the display 2. The identification information display control section 611 is capable of changing the display order of the cable information stored in the cable information memory section 641 based on a selection frequency and/or a selection order of a cable-like member by a user.

Figure 7:
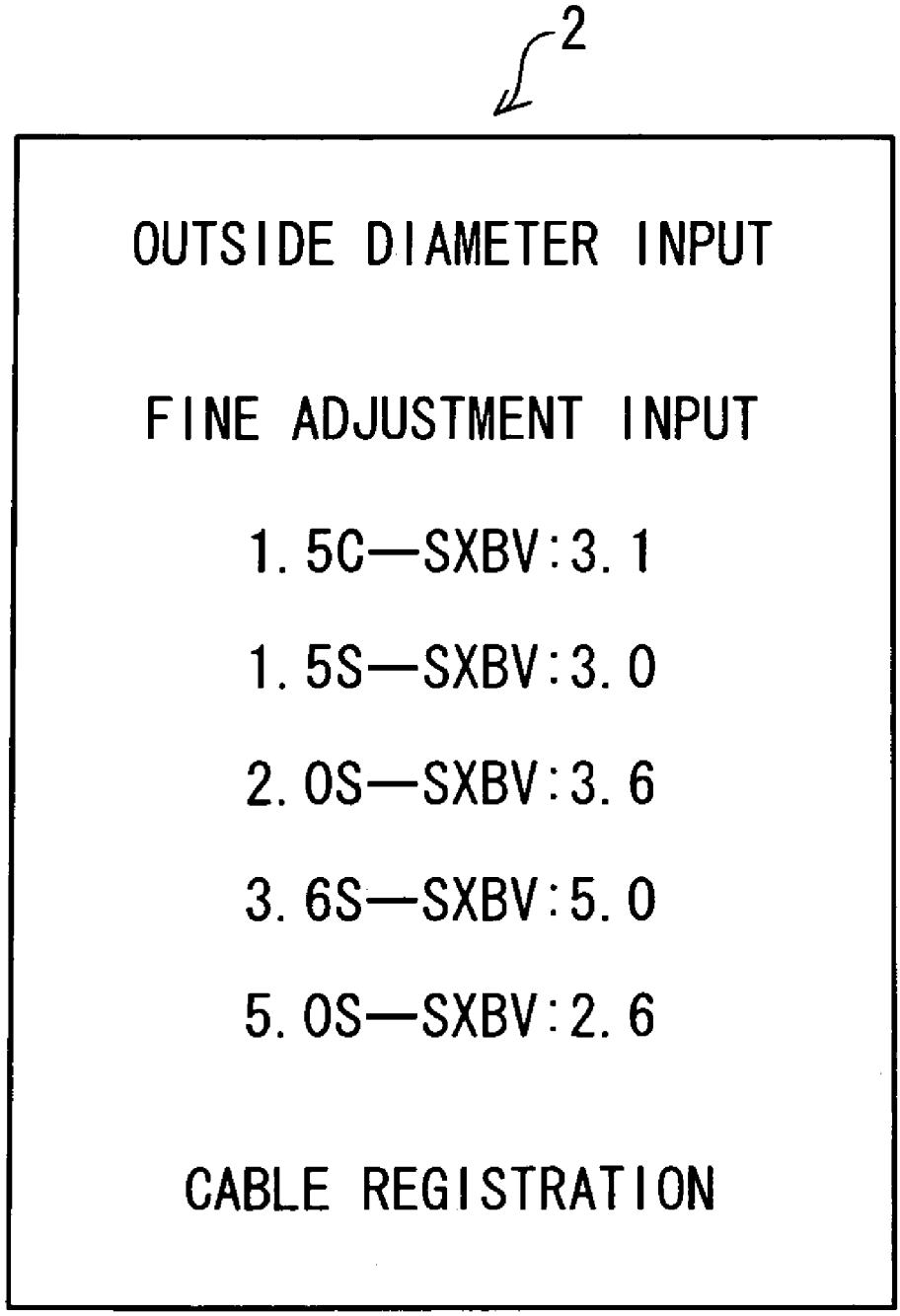
FIG. 7 is a list of cable information to be indicated on a display of the tape printer shown in FIG. 1 and an example of indication of user selected character string.

Here, the cable information and the user selecting character string will be described with reference to FIG. 7. FIG. 7 shows an example of indication of the list of the cable information to be displayed on the display 2, and the user selecting character string. On the display 2, plural pieces of the cable information (each piece includes a pair of information including a cable designation and the outside diameter, five kinds: "1.5C-SXBV: 3.1", "1.5S-SXBV: 3.0", "2.0S-SXBV: 3.6", "3.6S-SXBV: 5.0", "5.0S-SXBV: 2.6" are shown in FIG. 7) and user selecting character strings (three kinds "outside diameter input", "fine adjustment input" and "cable registration" in FIG. 7) are displayed. The "outside diameter input" here starts a processing of inputting the cable outside diameter value directly by a user. The "fine adjustment input" starts the fine adjustment input processing which will be described later. Further, the "cable registration" starts the cable information registration processing which will be described later.

The label length determining section 612 computes an outside peripheral length of a cable by multiplying the cable outside diameter value (diameter) with the ratio of circumference of a circle to its diameter and in case of the cable label of type A, it is determined that a computed value is the length of the label region 13. On the other hand, the label length determining section 612 determines that a computed value is the length of the cable region 16 in case of the cable label of type B. As the cable outside diameter value, a value input by a user preliminarily and selected by the user upon manufacturing of the label is used. Because according to this embodiment, the label length is determined based on the outside diameter value of the cable, a predetermined value of the cable-like member can be used as it is, so that it does not have to be computed each time when the label is produced.

The fine adjustment section 617 adjusts the length of the label region 13, or the cable region 16 determined by the label length determining section 612 finely based on a fine adjustment parameter registered by a user. Thus, a gap between the length of the label region 13 or the cable region 16 obtained, theoretically by calculation based on the outside diameter value of the cable-like member and the actually necessary length of the label region 13 or the cable region 16 can be filled, so that excess or shortage in length of the label region 13 or the cable region 16 is hardly generated when the cable label is wound around the cable-like member.

According to this embodiment, the fine adjustment section 617 is capable of adjusting the length of the label region 13 or the cable region 16 concerning individual cable-like members stored in the cable information memory section 641 finely. For the reason, a deviation in manufacturing dimension of the cable-like member can be dealt with for each of the cable-like members.

As a modification, the fine adjustment section 617 may be capable of adjusting the length of the label region 13 or the cable region 16 concerning plural cable-like members stored in the cable information memory section 641 finely, i.e., as a batch. Consequently, the gap between the shape of the cable label theoretically obtained from calculation based on dimensions of the cable-like member and the shape of a cable label actually necessary can be considered for a batch of cables and their labels.

The overlapping region length determining section 616 determines the length of the overlapping region 14 for the cable labels 11*a*, 11*b* of type A and the length of the label regions 15*a*, 15*b* for the cable labels 12*a*, 12*b* of type B. The lengths of the overlapping region 14 and the label region 15*a*, 15*b* determined by the overlapping region length determining section 616 increase as the outside diameter of the cable-like member increases. As a result, the cable label becomes unlikely to be separated in the overlapping region 14 and the label regions 15*a*, 15*b*.

The print image generating section 613 generates a print image of a character string stored in the character string memory section 631. The generation of the print image is a processing of expanding a dot pattern on a working area of the RAM 63 corresponding to text data about character string, character size determined by the character size determining section 614, font shape and presence/absence of modification of characters about bold letter, oblique letter and the like and modification of row about frame.

The character size determining section 614 adjusts the character size of the character string of a print object so that print image generated by the print image generating section 613 is within a print range. The print range mentioned here refers to a range in which the character string is to be printed, set up within the label region 13 indicated in FIGS. 2A, B and the label region 15*a*, 15*b* indicated in FIGS. 4A, B. A character string of an appropriate size corresponding to the outside diameter of the cable-like member can be printed by the character size determining section 614.

The print image arranging section 615 arranges the print image generated by the print image generating section 613 in the label regions 13, 15*a*, 15*b* based on the content of print setting stored in the flash memory 64 or the RAM 63. Consequently, the cable label 11*a*, 11*b*, 12*a*, 12*b* shown in FIGS. 2A-B and FIGS. 4A-B are obtained.

Figure 8:
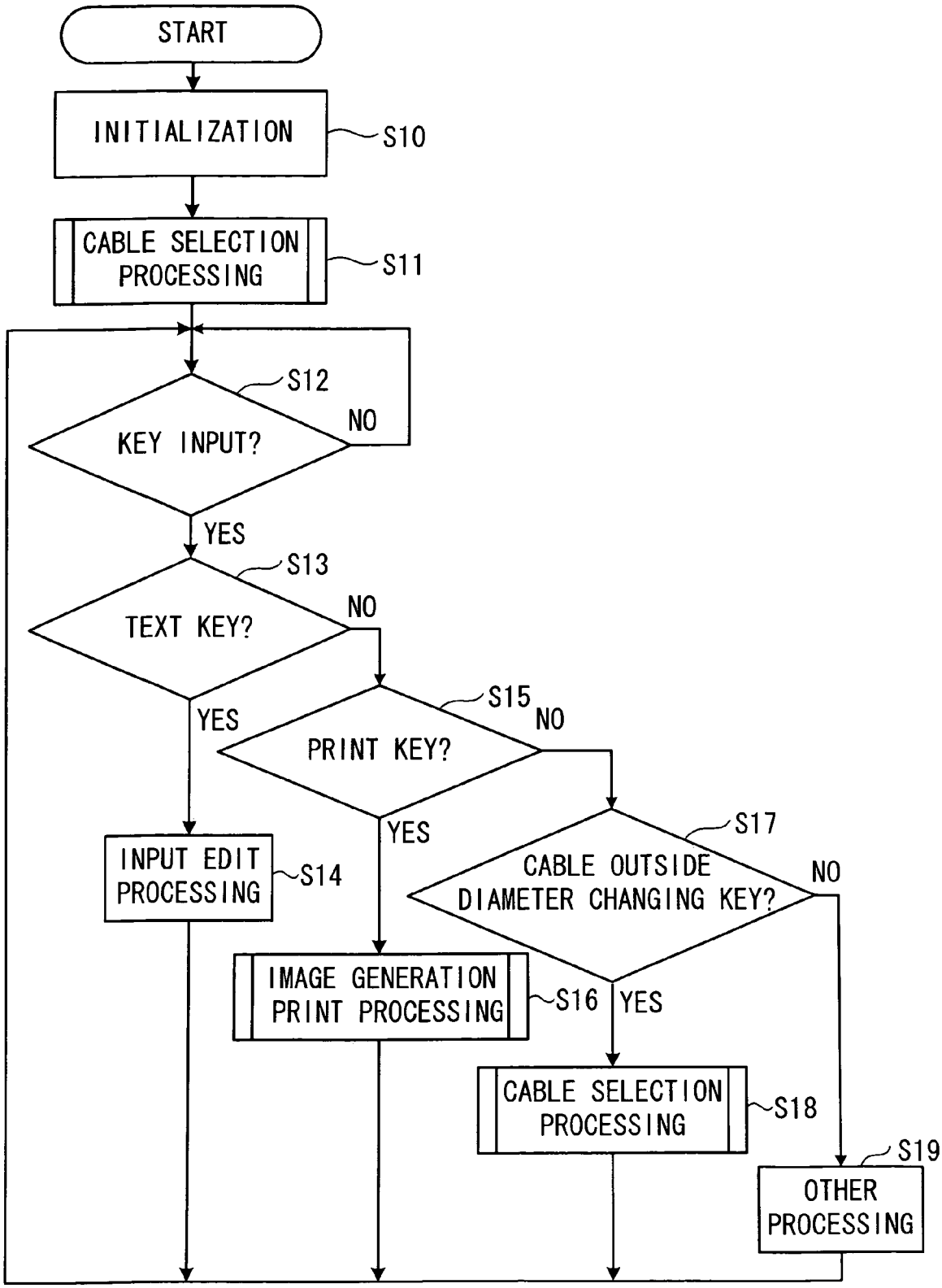
FIG. 8 is a flow chart indicating a processing procedure in the tape printer shown in FIG. 1.

Next, an operation of the tape printer 1 of this embodiment will be described with reference to FIG. 8. FIG. 8 is a flow chart showing the procedure of an entire operation of the tape printer 1. When the power of the tape printer 1 is turned ON, the operation of the tape printer 1 is started. First, the processing proceeds to step S10 (hereinafter abbreviated as S10, the other steps are identified in the same manner), in which the tape printer 1 is entirely initialized. The operations of the CPU 61, RAM 63 and interface unit 66 are checked and initialized, and further, the operations of the display 2, which is connected with the interface unit 66, and thermal head 4 are checked and the hardware is initialized. If there is no abnormality, data and respective functions stored in the RAM 63 are initialized. After these processings are completed, an operation screen is displayed on the display 2. After that, the processing proceeds to S11.

In S11, the cable selection processing is performed. This is a processing in which a screen similar to the one in FIG. 7 is indicated on the display 2 in order for a user to select one of the cables. The details of the cable selection processing will be described later. After the cable selection is completed, the processing proceeds to S12.

In S12, whether or not key input is carried out through the keyboard 3 by a user is determined. Consequently, a user is enabled to execute the operation of the tape printer 1 such as input of the character string to be stored in the character string memory section 631 by making key input through the keyboard 3 while looking at the display screen represented on the display 2. The tape printer 1 stands by in a condition capable of inputting the character string when initialization is completed, so that a user can input a character string of a print object through the text key arranged on the keyboard 3. In the standby condition for input also, a function can be called by inputting a function allocation key which calls each function such as print key. If any key is input by a user (S12: YES), a key cord of the input key is memorized in the working area of the RAM 63 and the processing proceeds to S13. If no key is input by a user (S12: NO), the processing proceeds to S12.

In S13, whether or not the input key is a text key is determined according to the key cord of the key input in S12. If the key input in S12 is a text key (S13: YES), the processing proceeds to S14, in which input edit processing is carried out. The input edit processing mentioned here is a working of introducing a text cord corresponding to the key cord of a key cord memorized in the working area in the RAM 63 and storing that text cord in the character string memory section 631 as character data. If the input edit processing is completed, the processing proceeds to S12 again. If the key input in S12 is not a text key (S13: NO), the processing proceeds to S15.

In S15, whether or not the key input in S12 is a print key is determined. If the key input in S12 is a print key (S15: YES), the processing proceeds to S16, in which the image generation print processing is carried out. The image generation print processing mentioned here is a working of arranging an image generated by the print image generating section 613 in the label region 13 or the label regions 15*a*, 15*b* by the print image arranging section 615. If the image generation print processing is completed, the processing proceeds to S12 again. If the key input in S12 is not a print key (S15: NO), the processing proceeds to S17.

In S17, whether or not the key input in S12 is a cable outside diameter changing key is determined. If the key input in S12 is a cable outside diameter changing key (S17: YES), the processing proceeds to S18, in which the cable selection processing is carried out in the same way as S11. If the cable selection processing is completed, the processing proceeds to S12, in which the processing stands by for key input by a user. Unless the key input in S12 is the cable outside diameter changing key (S17: NO), the processing proceeds to S19, in which other processings are carried out. Other processings mentioned here are, for example, processings for function calling keys other than the cable outside diameter changing key or a processing of the cursor key. If other processings are completed, the processing proceeds to S12 again. Termination of the control unit of the tape printer 1 is realized by turning off the power switch of the tape printer 1.

Figure 9:
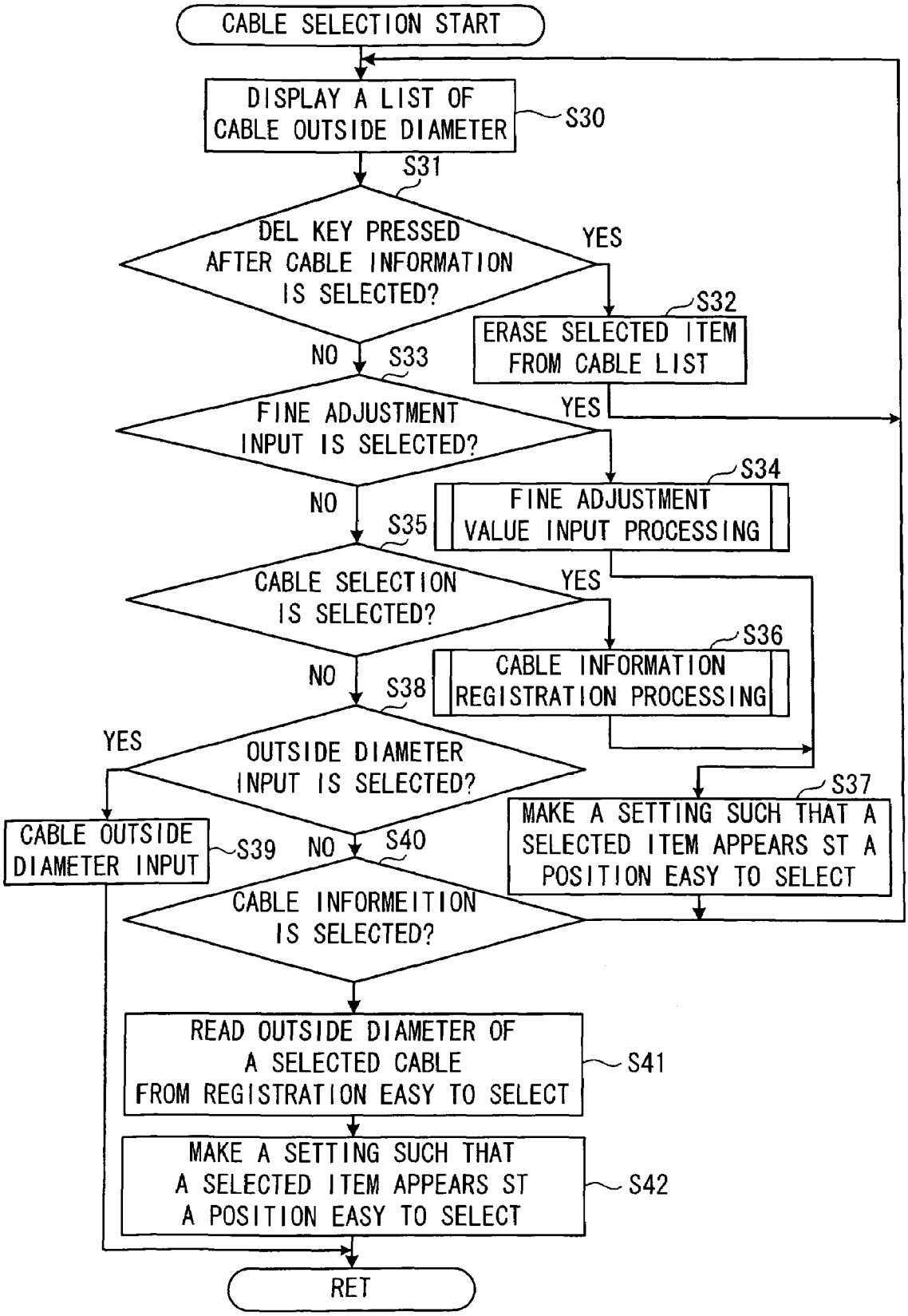
FIG. 9 is a flow chart indicating the procedure of cable selection processing in FIG.8.

Next, the detail of the cable selection processing in S11 and S18 on the flow chart of FIG. 8 will be described. FIG. 9 is a flow chart about the procedure of the cable selection processing. In the cable selection processing, in S30, the screen of FIG. 7 including a list of cable information memorized in the cable information memory section 641 by the identification information display control section 611 is displayed on the display 2 and the processing proceeds to S31.

In S31, whether or not the DEL key on the keyboard 3 is pressed with the cursor set on any cable designation by a user is determined according to the list of cable information displayed in S31. If the DEL key on the keyboard 3 is pressed with the cursor set on the designation (S21: YES), the processing proceeds to S32, in which cable information relating to a selected designation is deleted from the cable information memory section 641. If the deletion is completed, the processing proceeds to S30, in which the list of cable information is displayed so as to wait for the user's operation. Unless the DEL key on the keyboard 3 is pressed with the cursor set on the cable designation in S31 (S31: NO), the processing proceeds to S33.

In S33, whether or not the "fine adjustment input" is selected (ENTER key is pressed with the cursor set) by a user is determined. If the fine adjustment input is selected in S33 (S33: YES), the processing proceeds to S34, in which the fine adjustment section 617 carries out fine adjustment input processing. The fine adjustment input processing mentioned here is a working of the user's inputting fine adjustment parameter of cable outside diameter value memorized in the cable information memory section 641. The detail of the fine adjustment input processing will be described later. If the fine adjustment input processing is completed, the processing proceeds to S37.

In S37, the identification information display control section 611 sets information display such that next time this section can display the cable information, in which the fine adjustment parameter was input in S34, at a position easy to select (for example, topmost position) in the list of cable information. If the setting is completed, the processing proceeds to S30 again. Unless the fine adjustment input is selected in S33 (S33: NO), the processing proceeds to S35.

In S35, whether or not the "cable registration" is selected (ENTER key is pressed with the cursor set) is determined. If the cable registration is selected in S35 (S35: YES), the processing proceeds to S36, in which cable information registration processing is carried out. The cable information registration processing mentioned here is a working of memorizing the designation and outside diameter of a cable input through the keyboard 3 by a user in the cable information memory section 641. If the cable information registration processing is completed, the processing proceeds to S37 where the identification information display control section 611 sets information display such that next time this section can display the cable information, which was registered in S36, at a position easy to select in the list of cables. If the setting is completed, the processing proceeds to S30. Unless the cable registration is selected in S35 (S35: NO), the processing proceeds to S38.

In S38, whether or not the "outside diameter input" is selected (ENTER key is pressed with the cursor set) is determined by a user. If the outside diameter input is selected (S38: YES), the processing proceeds to S39, in which a user directly inputs a cable outside diameter value through the keyboard 3. If the input is completed, the flow chart shown in FIG. 9 is terminated and the processing returns to the flow chart of FIG. 8 and proceeds to S12 again. Unless the outside diameter input is selected (S38: NO), the processing proceeds to S40.

In S40, whether or not any one of plural pieces of cable information displayed on the list of the cable information is selected (ENTER key is pressed with the cursor set) is determined. If any one of the cable information pieces is selected (S40: YES), the processing proceeds to S41. Then, a cable outside diameter corresponding to a selected cable information is read out from the cable information memorized in the cable information memory section 641. After that, the processing proceeds to S42 where the identification information display control section 611 sets information display such that next time the selected cable information can be displayed at a position easy to select in the list of cable information. After this setting, the flow chart of FIG. 9 is terminated. Then, the processing returns to the flow chart of FIG. 8 and proceeds to S12 so as to wait for the user's key input. Unless any one of the cable information pieces is selected (S40: NO), the processing proceeds to S30 again.

Figure 10:
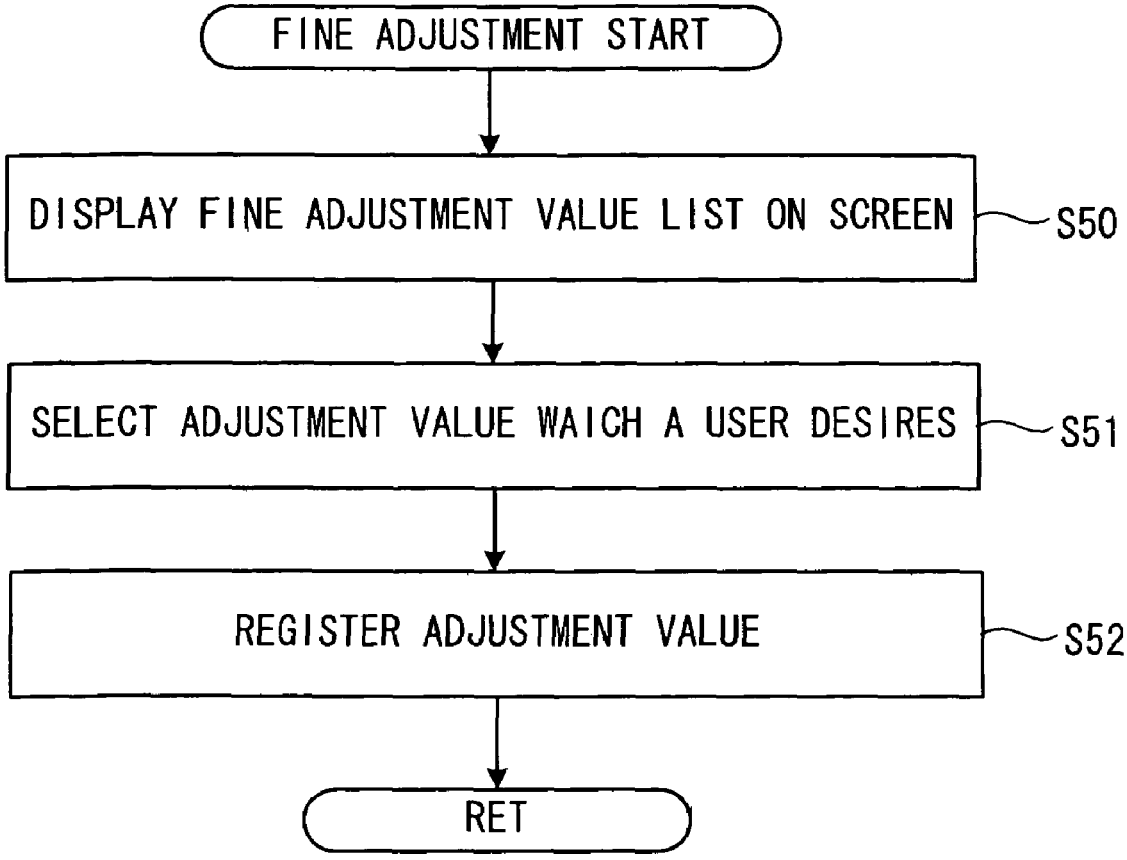
FIG. 10 is a flow chart indicating the procedure of fine adjustment input processing in FIG. 9.

Next, the fine adjustment input processing in S34 on the flow chart of FIG. 9 will be described with reference to FIG. 10. FIG. 10 is a flow chart about the fine adjustment input processing procedure. First, in S50, a fine adjustment value list screen is displayed on the display 2. Fine adjustment parameters, for example, from +30% to −25% with respect to the cable outside diameter are displayed at an interval of every 5% on the fine adjustment value list screen. If a user presses the ENTER key with the cursor set on any fine adjustment parameter, a given fine adjustment parameter is selected.

If the fine adjustment value list screen is displayed, the processing proceeds to S51, in which a user selects a desired adjustment value. After that, the processing proceeds to S52, in which the selected fine adjustment parameter is memorized in the flash memory 64 for each cable-like member memorized in the cable information memory section 641. Then, the flow chart of FIG. 10 is terminated and the processing goes back to the flow chart of FIG. 9.

Figure 11:
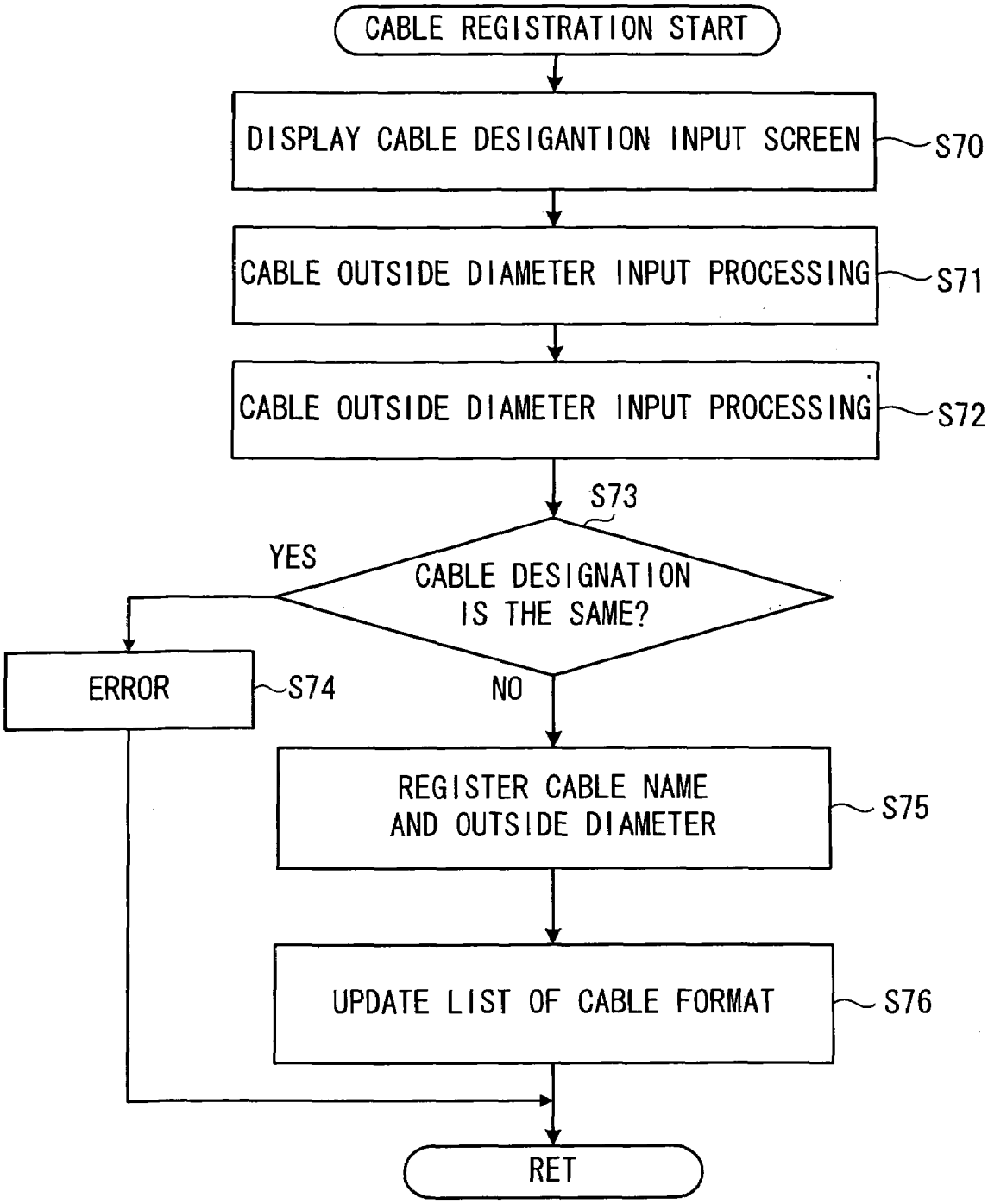
FIG. 11 is a flow chart indicating the procedure of cable information registration processing procedure in FIG. 9.

Next, the cable information registration processing in S36 on the flow chart of FIG. 9 will be described with reference to FIG. 11. FIG. 11 is a flow chart about the cable information registration processing procedure. First, in S70, a cable designation input screen is displayed on the display 2. After the display, the processing proceeds to S71, in which a user inputs a cable designation through the keyboard 3. The cable designation to be input here may be a cable designation which a user can discriminate easily or a type number or the like. Next, the processing proceeds to S72, in which an outside diameter corresponding to the inputted cable designation is input. If the input is completed, the processing proceeds to S73, in which whether or not the cable designation inputted in S71 is the same as a cable designation memorized in the cable information memory section 641 is determined. If the same cable designation as the cable designation inputted in S71 is memorized in the cable information memory section 641 (S73: YES), the processing proceeds to S74, in which that fact is displayed on the display 2 as an error. After that, the processing proceeds to S70 again.

Unless the same designation as the cable designation inputted in S71 is memorized in the cable information memory section 641 (S73: NO), the processing proceeds to S75, in which cable designation and its outside diameter value inputted in S71, S72 are registered in the cable information memory section 641. If the registration is completed, the processing proceeds to S76, in which the list of the cable information is updated. After that, the flow chart of FIG. 11 is terminated and the processing returns to the flow chart of FIG. 9.

Figure 12:
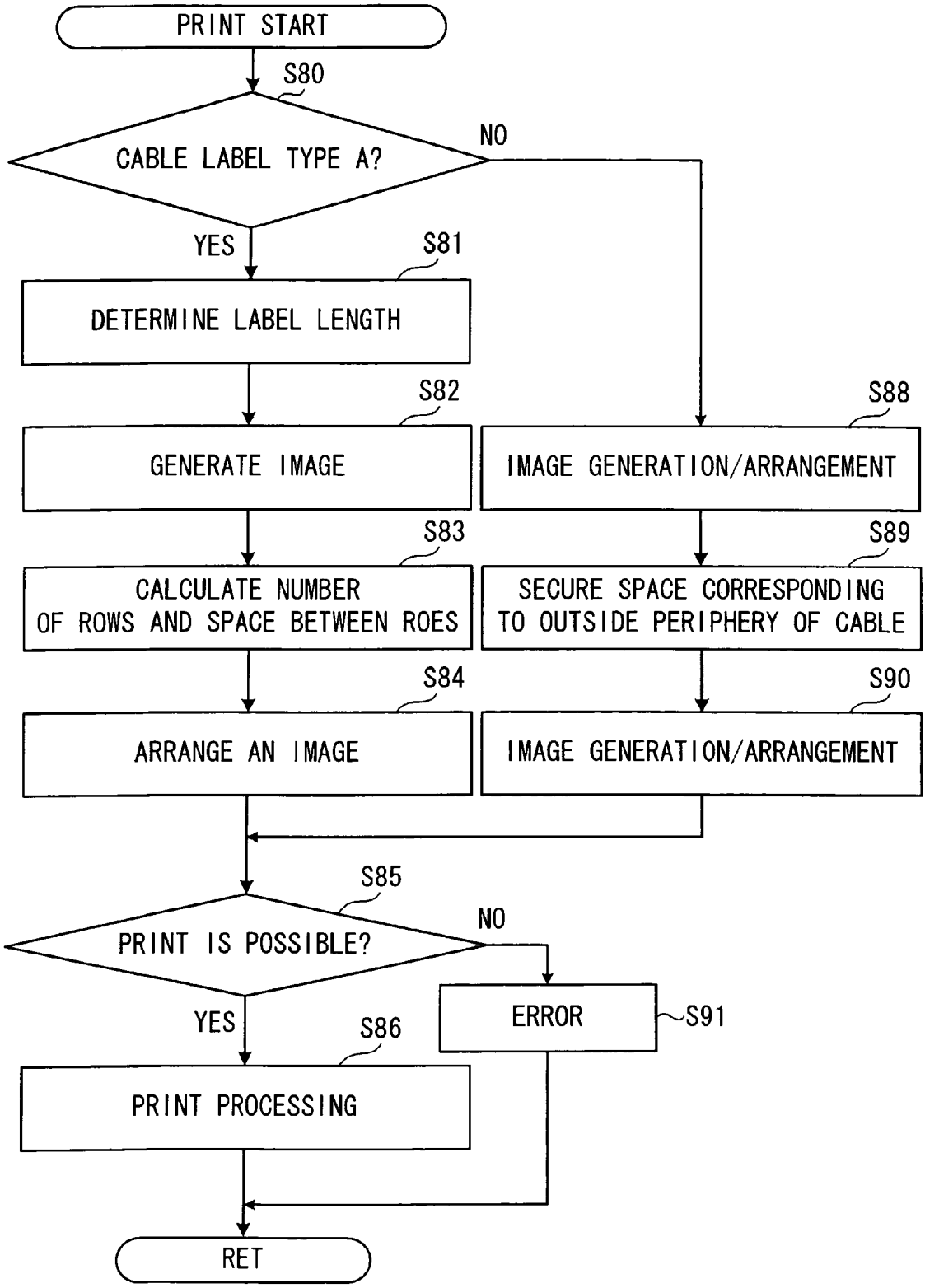
FIG. 12 is a flow chart indicating the procedure of image generation print processing in FIG. 8.

Next, the image generation print processing of S16 in the flow chart of FIG. 8 will be described with reference to FIG. 12. FIG. 12 is a flow chart about the image generation print processing procedure. First, whether or not the cable label to be produced in S80 is the cable label 11*a*, 11*b* of type A is determined. If the object cable label is the cable label 11*a*, 11*b* of type A (S80: YES), the processing proceeds to S81, in which the length of the label region 13 is determined by the label length determining section 612 based on a cable outside diameter value. If the fine adjustment parameter is registered at this time, the fine adjustment section 617 adjusts the length of the label region 13 finely based on the fine adjustment parameter. Then, after the length of the cable labels 11*a*, 11*b* is determined, the processing proceeds to S82.

In S82, a print image is generated by the print image generating section 613. The size of the character string is adjusted by the character size determining section 614 so that the generated print image can be accommodated within the label region 13. After that, the processing proceeds to S83.

In S83, the number of rows which can be printed within the print range and a space between the rows are computed based on the length of the label region 13 determined in S81. More specifically, in case where the input character string is of a single row when the number of character strings to be printed on the cable labels 11*a*, 11*b* is set up, the number of the set character strings turns to the number of rows as it is. If it is so set to change the plural rows of the character strings to a single row when the input character string is of plural rows, the number of the set character strings turns to the number of rows as it is. On the other hand, if it is set to change each of plural rows of the character strings to a single row, the number of rows is obtained by multiplying the number of the set character strings with the number of input character strings.

If a distance between respective character strings (space between rows) to be printed on the cable labels 11*a*, 11*b* is set up, the number of rows which allows the character strings to be disposed on both ends in the length direction of the label region 13 of the cable label 11*a*, 11*b* and then remaining character strings to be disposed at an equal interval between the character strings disposed on the both ends is computed based on a print range, a distance between the character strings and the height of the character string. At this time, if the input character string is composed of plural rows, the same two ways as described above are applied.

Next, a space between rows is computed based on a computed number of rows which can be printed out. If the number of character strings to be printed on the cable label 11*a*, 11*b* is set up, a space between rows is computed so that the character strings are disposed on both ends in the length direction of the label region 13 of the cable labels 11*a*, 11*b* and remaining character strings are disposed at an equal interval between the character strings disposed on the both ends based on the length of the label region 13 determined by S81, a computed number of rows and the height of the character string. Although a fraction may occur in the computation of the space between rows, this is adjusted by allocating the fraction on part of the space between the rows. Strictly speaking, each space between rows is not equally the same, but there is little difference in visual effect among those spaces. If the computation on the space between the rows is terminated, the processing proceeds to S84.

In S84, the print image generated in S81 is arranged within the label region 13 by the print image arranging section 615 based on the number of rows and space between rows computed in S83. Here, the arrangement directions of the character strings to be printed can be inverted alternately. After the arrangement is completed, the processing proceeds to S85.

In S85, whether or not the print image arranged in S84 can be printed is determined depending on whether or not various conditions such as remainder of a tape are satisfied. If the print image generated in S82 can be printed (S85: YES), the processing proceeds to S86, in which print processing is carried out. The print processing mentioned here is a working of printing on the print tape by means of the thermal head 4 based on a print image arranged by the print image arranging section 615. After the print processing is completed, the print tape is carried by an overlapping region length determined by the overlapping region length determining section 616 and then, the flow chart of FIG. 12 is terminated. Then, the processing returns to the flow chart of FIG. 8 and proceeds to S12 again. Unless the print image generated in S82 can be printed out (S85: NO), the processing proceeds to S91, in which that fact is displayed on the display 2 as an error. After that, the flow chart of FIG. 12 is terminated and the processing returns to the flow chart of FIG. 8 and proceeds to S12 again.

If, in S80, the cable label to be produced is not the cable label 11*a*, 11*b* of type A (that is, in case where it is the cable label 12*a*, 12*b* of type B) (S80: NO), the processing proceeds to S88. In S88, the print image of a character string memorized in the character string memory section 631 is generated by the print image generating section 613, and then it is disposed in the label region 15*a* (whose length is determined by the overlapping region length determining section 616) shown in FIGS. 4A, B by the print image arranging section 615. Then, the processing proceeds to S89, in, which the label length determining section 612 computes the length of the cable region 16 based on the cable outside diameter value and secures a space equal to the length of the computed cable region 16. Then, the processing proceeds to S90. Securing the space here means avoiding arrangement of the print image in the space. In S90, the print image of a character string memorized in the character string memory section 631 is generated by the print image generating section 613 and disposed in the label region 15*b* (whose length is determined by the overlapping region length determining section 616) shown in FIGS. 4A, B by the print image arranging section 615. The direction of the character string to be printed cap be inverted. After the print image is arranged, the processing proceeds to S85. In case of the cable label 12*a*, 12*b* of type B, a processing of carrying the print tape by the same amount as an overlapping region length determined by the overlapping region length determining section 616 after the print processing is completed is avoided unlike the type A.

As described above, if it is intended to produce the cable label 11*a*, 11*b* or the cable label 12*a*, 12*b* to be attached to the cable 18 according to this embodiment, a user does not have to compute the label length from the outside diameter of the cable each time when the print is executed and a user can select a desired cable 18 from cable information indicated on the display 2 through the keyboard 3. Consequently, burden on a user can be reduced. Additionally, there is no fear that any label deviated from a proper dimension due to computation error may be printed out.

Next, a second embodiment of the present invention will be described. The structure of the print control apparatus of this embodiment is different from the first embodiment in the following regards: the label length determining section 612 does not exist, the cable information memory section 641 memorizes the cable designation and the length of the cable label (label region 13 or the length of the cable region 16) in correspondence therebetween, and the print image arranging section 615 arranges a print image within the label region 13, which is memorized in the cable information memory section 641, or within the label regions 15*a*, 15*b* adjacent to the cable region 16.

According to this embodiment, because the cable information memory section 641 memorizes not the outside diameter value of the cable but the length of the label region 13 or the cable region 16, the CPU 61 does not need to compute the length of the label region 13 or the cable region 16 from the outside diameter value of the cable.

The operation of the print control apparatus of this embodiment is different from the first embodiment in that the length of the cable label (length of the label region 13 or the cable region 16) is read out in S41 of FIG. 9 instead of the outside diameter value of the cable. After this reading, fine adjustment is carried out. Additionally, it is different from the first embodiment also in that the length of the label region 13, or the cable region 16 is input in S72 of FIG. 11 instead of the outside diameter value to the designation of a cable input in S71, and that the length of the label region 13 or the cable region 16 is registered in the cable information memory section 641 in S75 instead of the outside diameter value of the cable. Further, the length determination processing of the label region 13 or the cable region 16, which is carried out in S81 and S89, is avoided (processing for securing a space equal to a cable outside periphery is carried out in S89).

According to the second embodiment of the present invention, substantially the same advantage as the first embodiment can be obtained. Additionally, this embodiment is capable of executing processing quickly in correspondence to omitting an operation for determining the length of the label region 13 or the cable region 16.

Although the preferred embodiments of the present invention have been described above, the present invention is not restricted to the above-described embodiments but may be modified in various ways. For example, according to the above-described respective embodiments, an object on which the label is to be attached is a cable and the present invention is applicable to a cylindrical cable-like member or cable-like members having a similar shape.

The cable label of type A does not need to be provided with the overlapping region. In this case, the label length determining section 612 comes to determine the entire length of the cable label 11*a*, 11*b* although according to the above-described embodiment, the label length determining section 612 determines the length of part of the cable label 11*a*, 11*b*. Further, although according to the above embodiments, the overlapping region length is changed corresponding to the dimension of the cable, the overlapping region length may be fixed regardless of the dimension of the cable.

Although the above embodiments have been described by taking the length of the cable label as an example, a structure in which other dimension than the length thereof is determined may be applied.

Although according to the above embodiments, the outside diameter value is used as a dimension relating to the cable-like member, it is permissible to use a dimension other than the outside diameter value. Further, although according to the above embodiments, the cable information can be rewritten by a user, it is permissible to fix the cable information so that it cannot be rewritten by a user. Further although according to the above embodiment, the cable information is displayed on a display built in the tape printer, it may be displayed on a personal computer connected to the printer.

Although according to the above embodiments, the print image is disposed in the width direction of the cable label, it may be disposed in the length direction of the cable label. Although according to the above embodiments, the interval of the character strings printed on the cable label is all equal, the present invention is not restricted to the equal interval but may be unequal to an extent that no feeling of disharmony is generated in visual impression. For example, in case where the character string is composed of multiple rows, spaces between the rows in the character string may be unequal.

Although according to the above embodiments, the character size and print image size are adjusted by the character size determining section 614, such adjustments may be avoided. Although according to the above embodiments, data to be memorized by the character string memory section 631 is of text data, for example, it is permissible to memorize code or image data corresponding to memorized image data.

Although according to the above embodiments, fine adjustment is carried out by percentage at the time of fine adjustment input, the fine adjustment may be carried out by other unit. For example, the fine adjustment may be carried out by adding or subtracting to/from a memorized outside diameter value by millimeter unit.

Although the above embodiments have been described about a type in which the print control apparatus is built in the tape printer, the present invention is not restricted to such a structure, but the print control apparatus may be built in other printer than the tape printer or constructed on a personal computer connected to a printer.

The preferred embodiments related to labels for cables. However, the invention is applicable to labels that are to be wrapped around various types of objects including objects other than cables such as, for example, pipes, rods, tubes, etc. In addition, the cross-section of the wrapped object could be square or irregular as occurs, for example, in some double-strand or triple-strand cables. In this regard, "cable-like" and "cylindrical" as used herein, are intended to cover all those various shapes and wrapped objects.

In the illustrated embodiment, the controller (control section 6) preferably is implemented using a suitably programmed general purpose computer, e.g., a microprocessor, microcontroller or other processor device (CPU or MPU). It will be appreciated by those skilled in the art, that the controller also can be implemented as a single special purpose integrated circuit (e.g., ASIC) having a main or central processor section for overall, system-level control, and separate sections dedicated to performing various different specific computations, functions and other processes under control of, the central processor section. The controller also can be implemented using a plurality of separate dedicated or programmable integrated or other electronic circuits or devices (e.g., hardwired electronic or logic circuits such as discrete element circuits, or programmable logic devices such as PLDs, PLAs, PALs or the like). The controller also can be implemented using a suitably programmed general purpose computer in conjunction with one or more peripheral (e.g., integrated circuit) data and signal processing devices. In general, any device or assembly of devices on which a finite state machine capable of implementing the described procedures can be used as the controller of the invention.

While the invention has been described with reference to exemplary embodiments, it is to be understood that the invention is not limited to the exemplary embodiments or constructions. While the various elements of the exemplary embodiments are shown in various combinations and configurations, which are exemplary, other combinations and configurations, including more, less or only a single element, are also within the spirit and scope of the invention.

What is claimed is:

1. A print control apparatus comprising:

character string memory means for storing a character string to be printed on a label to be wound around a cylindrical member;

print image generating means for generating a print image of the character string stored in the character string memory means;

information memory means having identification information and dimension information stored thereon, the identification information for identifying each of plural different cylindrical members, the dimension information being associated with the identification information and including an outer diameter for each of the plural different cylindrical members;

label configuration determining means for, when an outer diameter is selected from a plurality of outer diameters of cylindrical members by a user and a cylindrical member associated with the user-selected outer diameter corresponds to one of the plural cylindrical members memorized in the information memory means, determining at least part of a label configuration based on the dimension of the selected cylindrical member memorized in the information memory means; and print image arranging means for arranging a print image generated by the print image generating means within at least one of a range corresponding to the at least part of the label configuration determined by the label configuration determining means and a range adjacent to the range.

2. The print control apparatus according to claim 1, further comprising adjacent range configuration determining means for determining the configuration of a range adjacent to the range corresponding to the at least part of the label configuration of the label.

3. The print control apparatus according to claim 2, wherein the adjacent range configuration determining means changes the configuration of the adjacent range corresponding to the dimension of a cylindrical member.

4. A print control apparatus, comprising:

character string memory means for storing a character string to be printed on a label to be wound around a cylindrical member;

print image generating means for generating a print image of the character string stored in the character string memory means;

information memory means having identification information and dimension information stored thereon, the identification information for identifying each of plural different cylindrical members, the dimension information being associated with the identification information and including an outer diameter for each of the plural different cylindrical members for at least a part of a label configuration of the label to be wound around, and print image arranging means for, when an outer diameter is selected from a plurality of outer diameters of cylindrical members by a user and a cylindrical member associated with the user-selected outer diameter corresponds to any one of the plural cylindrical members memorized in the information memory means, arranging a print image generated by the print image generating means within at least one of a range corresponding to the at least a part of the label configuration for the selected cylindrical member memorized in the information memory means and a range adjacent to the range.

5. The print control apparatus according to claim 4, wherein a memory content of the information memory means is rewritable based on a user's operation.

6. The print control apparatus according to claim 4, further comprising identification information display control means for controlling representation of identification information of a cylindrical member memorized in the information memory means on a display.

7. The print control apparatus according to claim 6, wherein the identification information display control means changes a display order of identification information of the cylindrical member on the display corresponding to a selection frequency or selection order of the cylindrical member by a user.

8. The print control apparatus according to claim 4, further comprising fine adjustment means for adjusting the at least a part of the label configuration.

9. The print control apparatus according to claim 8, wherein the fine adjustment means adjusts the at least a part of the label configuration finely and independently for individual cylindrical members.

10. The print control apparatus according to claim 8, wherein the fine adjustment means adjusts the at least a part of the label configuration finely and collectively for a plurality of cylindrical members.

11. The print control apparatus according to claim 4, wherein the print image arranging means arranges a print image generated by the print image generating means in a width direction of the label.

12. The print control apparatus according to claim 4, wherein the print image arranging means arranges a print image generated by the print image generating means substantially in a center of a print range, in a width direction of the label.

13. The print control apparatus according to claim 4, wherein the print image arranging means arranges plural print images generated by the print image generating means at an equal interval in a width direction of the label.

14. The print control apparatus according to claim 4, wherein the print image arranging means arranges plural print images generated by the print image generating means in a width direction of the label while at least one print image, having an arrangement direction which is 180° different from the others, is included in the plural print images.

15. The print control apparatus accordingto claim 4, wherein the print image arranging means arranges plural print images generated by the print image generating means in a width direction of the label while arrangement directions of the plural print images are different by 180° alternately.

16. The print control apparatus according to claim 4, wherein the print image arranging means arranges plural print images generated by the print image generating means in a width direction of the label while of the plural print images, two print images disposed most outside are different by 180° in arrangement direction.

17. The print control apparatus according to claim 4, further comprising character size determining means for determining a size of a print image, corresponding to the dimension of a cylindrical member selected by a user.

18. The print control apparatus according to claim 4, wherein the information memory means includes a nonvolatile memory device.

19. A print control apparatus, comprising:

a character string memory that stores a character string to be printed on a label to be wound around a cylindrical member;

a print image generator that generates a print image of the character string stored in the character string memory;

a label information memory that has identification information and dimension information stored thereon, the identification information for identifying each of plural different cylindrical members for the label to be wound around, the dimension information being associated with the identification information and including an outer diameter for each of the plural different cylindrical members; and a controller that, when an outer diameter is selected from a plurality of outer diameters of cylindrical members by a user and a cylindrical member associated with the user-selected outer diameter to one of the plural cylindrical members memorized in the label information memory, arranges a print image generated by the print image generator within at least one of a range corresponding to at least a part of a label configuration for the selected cylindrical member memorized in the label information memory and a range adjacent to the range.

20. The print control apparatus according to claim 19, wherein the controller determines a configuration of the range adjacent to the range corresponding to the at least a part of the label configuration.

21. The print control apparatus according to claim 20, wherein the controller changes the configuration of the range adjacent to the range corresponding to the at least a part of the label configuration based on the dimension information.

22. The print control apparatus according to claim 19, wherein a memory content of the label information memory is rewritable based on a user's operation.

23. The print control apparatus according to claim 19, wherein the controller controls a representation on a display of the identification information of a cylindrical member memorized in the label information memory.

24. The print control apparatus according to claim 23, wherein the controller changes a display order of the identification information of the plural cylindrical members on the display based on a selection frequency or selection order of the cylindrical members by a user.

25. The print control apparatus according to claim 19, wherein the controller enables a user to adjust the at least a part of the label configuration readout from the label information memory.

26. The print control apparatus according to claim 25, wherein the controller enables a user to adjust the at least a part of the label configuration finely and independently for individual cylindrical members.

27. The print control apparatus according to claim 25, wherein the controller enables a user to adjust the at least a part of the label configuration finely and collectively for a plurality of cylindrical members.

28. The print control apparatus according to claim 19, wherein the controller arranges a print image generated by the print image generator in a width direction of the label.

29. The print control apparatus according to claim 19, wherein the controller arranges a print image generated by the print image generator substantially in a center of a print range, in a width direction of the label.

30. The print control apparatus according to claim 19, wherein the controller arranges plural print images generated by the print image generator at an equal interval in a width direction of the label.

31. The print control apparatus according to claim 19, wherein the controller arranges plural print images generated by the print image generator in a width direction of the label while at least one print image, having an arrangement direction which is 180° different from the others, is included in the plural print images.

32. The print control apparatus according to claim 19, wherein the controller arranges plural print images generated by the print image generator in a width direction of the label while arrangement directions of the plural print images are different by 180° alternately.

33. The print control apparatus according to claim 19, wherein the controller arranges plural print images generated by the print image generator in a width direction of the label while of the plural print images, two print images disposed most outside are different by 180° in an arrangement direction.

34. The print control apparatus according to claim 19, wherein the controller determines a size of a print image corresponding to a dimension of a cylindrical member selected by a user.

35. The print control apparatus according to claim 19, wherein the label information memory includes a nonvolatile memory device.

* * * * *